US006390358B1

(12) United States Patent
Stewart et al.

(10) Patent No.: US 6,390,358 B1
(45) Date of Patent: May 21, 2002

(54) PAPERBOARD CAN WITH AN INTEGRATED PAPERBOARD LID HAVING A HINGE ON THE LID

(75) Inventors: Noel G. Stewart; L. David Fielder, both of Oxford, GA (US); Joseph J. Hart, Philadelphia; Angela L. Rowland, Collegeville, both of PA (US); Suzanne Theresa Barker, St. Louis Park, MN (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/527,996

(22) Filed: Mar. 17, 2000

Related U.S. Application Data

(63) Continuation-in-part of application No. 09/437,968, filed on Nov. 10, 1999.

(60) Provisional application No. 60/120,030, filed on Feb. 13, 1999.

(51) Int. Cl.[7] ..... B65D 43/16

(52) U.S. Cl. ..... 229/125.09; 229/125.08; 229/125.17; 229/210; 229/221; 229/223; 229/229

(58) Field of Search ..... 229/125.09, 125.17, 229/210, 221, 223, 229, 5.6, 131, 125.05, 125.08, 125.19, 125

(56) References Cited

U.S. PATENT DOCUMENTS 685,900 A * 11/1901 Anderson ..... 229/5.5
1,415,543 A * 5/1922 Gannon ..... 229/131
1,903,099 A * 3/1933 Erhard et al. ..... 229/5.5
2,032,296 A * 2/1936 Meier et al. ..... 229/5.5
2,033,889 A * 3/1936 Bombard ..... 229/5.5
2,132,206 A * 10/1938 Domenico et al. ..... 229/5.5
2,144,273 A * 1/1939 Raymond ..... 229/5.5
2,580,586 A * 1/1952 O'Reilly ..... 229/131
3,206,100 A * 9/1965 Wenger ..... 229/125
4,583,679 A * 4/1986 Johnson ..... 229/131
4,768,703 A * 9/1988 Sosler et al. ..... 229/131

FOREIGN PATENT DOCUMENTS

EP 0611703 B1 * 5/1997 ..... 229/125.5 X

* cited by examiner

*Primary Examiner*—Lee Young
*Assistant Examiner*—Tri M. Mai
(74) *Attorney, Agent, or Firm*—Dick and Harris

(57) ABSTRACT

A paperboard container for releasably dispensing contents contained therein is convertible from a substantially sealed orientation to a substantially open, dispensing orientation and back to the substantially sealed orientation. The paperboard container comprises a tubular container member, a bottom member and a top member, with the top member being telescopically received within the container member to seal the top member to the container. The top member is pivotable about the hinge portion and is pivotable to the sealed orientation to substantially reseal the container member.

17 Claims, 5 Drawing Sheets

PAPERBOARD CAN WITH AN INTEGRATED PAPERBOARD LID HAVING A HINGE ON THE LID

CROSS-REFERENCE TO RELATED APPLICATIONS

This application is a continuation-in-part of and claims the benefit of U.S. patent application Ser. No. 09/437,968, filed Nov. 10, 1999, which, in turn, claims priority of U.S. Provisional Application No. 60/120,030, filed Feb. 13, 1999.

BACKGROUND OF THE DISCLOSURE

1. Field of the Invention

The present invention is directed to paperboard lids for paperboard containers and, more specifically, to an integrated paperboard lid having a hinge on the lid.

2. Background Art

Paper containers are often used to hold consumer items such as cereals, grains, etc. To open the container, often, the consumer simply opens the entire top of the container. This allows access to the inner liner that holds the products. This arrangement is typical of boxes of breakfast cereal. Other boxes include a perforated portion on the side of the box, near the top, or on the top of the box, near the side. The perforated portion, when separated from the box, creates an openable flap that allows access to the interior of the box. This type of construction, which is often found on boxes of grain, soap and other products, does not allow for effective closing of the box.

It is therefore an object of the present invention to provide a container that is convertible from a substantially sealed orientation to a substantially open, dispensing orientation and back to the substantially sealed orientation.

It is also an object of the present invention to provide a container that is capable of remaining in a substantially open, dispensing orientation without obstructing the dispensing of contents contained therein.

It is a further object of the present invention to provide a container that is capable of reclosing from a substantially open orientation to a substantially sealed orientation without the loss of contents contained therein.

These and other objects of the present invention will become apparent in light of the present specification, claims and drawings.

SUMMARY OF THE INVENTION

The present invention is directed to a paperboard container for releasably dispensing contents contained therein. The container is convertible from a substantially sealed orientation to a substantially open, dispensing orientation and back to the substantially sealed orientation.

The paperboard container comprises a tubular body having an upper edge defining an upper opening. A lid includes a substantially planar lid panel member having a peripheral edge region, the lid panel member being operably configured to extend across at least a portion of the upper opening.

The lid further includes a surrounding band, operably affixed to the lid panel member along the peripheral edge region thereof. At least portions of the surrounding band are affixed to the tubular body along at least a portion of the upper edge thereof. The lid further has a fixed back portion, a hinge portion, and a movable front portion, pivotable between a closed position and an open position. The paperboard container further includes a container bottom opposite said lid.

The paperboard container further comprises, in a preferred embodiment of the invention, a membrane extending across the upper opening of the tubular body portion, under the lid panel, and substantially independent of the lid portion. The membrane may be positioned on the top edge of the upper opening of the tubular body portion. Alternatively, the membrane may be inserted into and affixed to inside surfaces of the upper opening of the tubular body portion.

The hinge portion may further comprise at least one locking tab operably extending from the hinge portion, when the movable front portion of the lid is in the open position, for frictionally engaging the membrane, to maintain the movable front portion of the lid in the open position.

The lid panel may be plug-shaped, so as to extend into the upper opening of the tubular body portion, when the movable front portion of the lid is in its closed position.

The movable front portion of the lid may include at least one tooth for engaging the container member upper edge when the top member is in its sealed orientation. The hinge portion may include at least two tabs extending rearwardly toward the rear portion, the at least two hinges being sized to engage the membrane when the movable front portion of the lid is in its open orientation and to hold the front portion in the open orientation.

The bottom preferably comprises a bottom panel inserted into and adhered to inside surfaces of a bottom end region of the tubular body portion.

In a preferred embodiment of the invention, the lid is formed by insertion of the lid panel into the band, the lid panel having a width and length greater than the width and length of the band, causing peripheral edges of the lid panel to become upturned and positioned against inside surfaces of the band, and the upturned peripheral edges of the lid panel are adhered to the inside surfaces of the band.

A topmost edge region of the band may be curled inward. Alternatively, a topmost edge region of the band is left in a straight vertical orientation. In a still further alternative embodiment, a topmost edge region of the band is curled outward.

According to one alternative embodiment of the invention, the upper edge of the tubular body is curled inward. Alternatively, the upper edge of the tubular body may be left in a straight vertical orientation. In a still further alternative embodiment, the upper edge of the tubular body is curled outward.

DETAILED DESCRIPTION OF THE DRAWINGS

Figure 1:
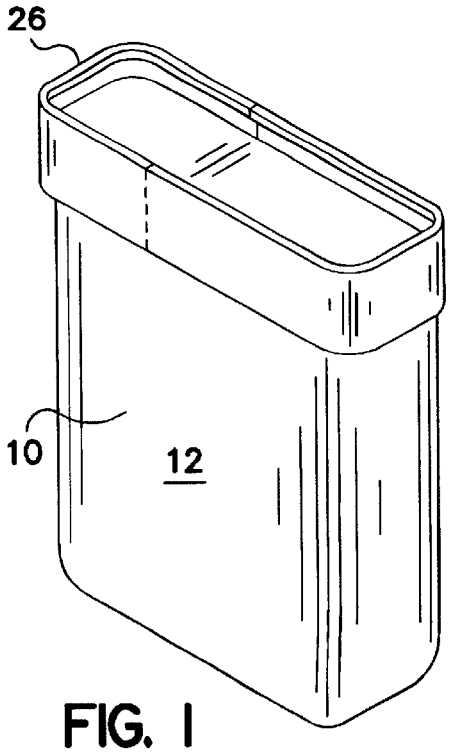
FIG. 1 is a perspective view of the paper can apparatus of the present invention.

While this invention is susceptible of embodiment in many different forms, there are shown in the drawings and will be described in detail herein, several specific embodiments with the understanding that the present invention is to be considered as an exemplification of the principles of the invention and is not intended to limit the invention to the embodiments illustrated.

Figure 2:
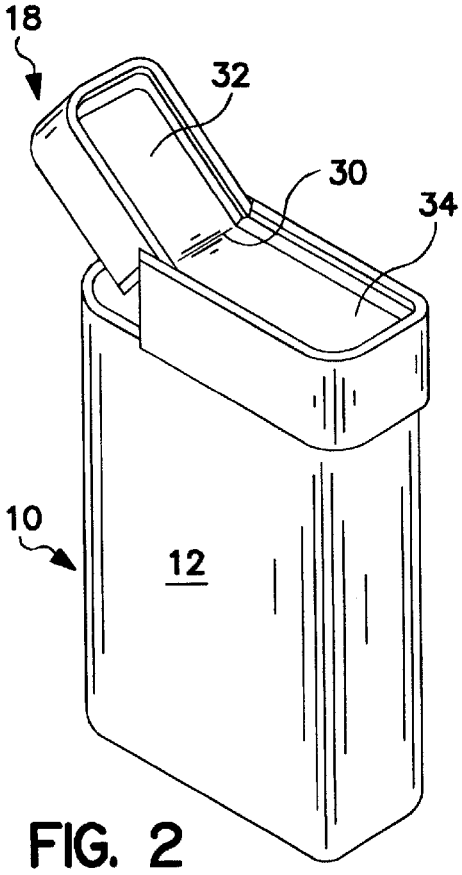
FIG. 2 is a perspective view of the paper can of FIG. 1, showing the flip open top in an opened position.
Figure 3:
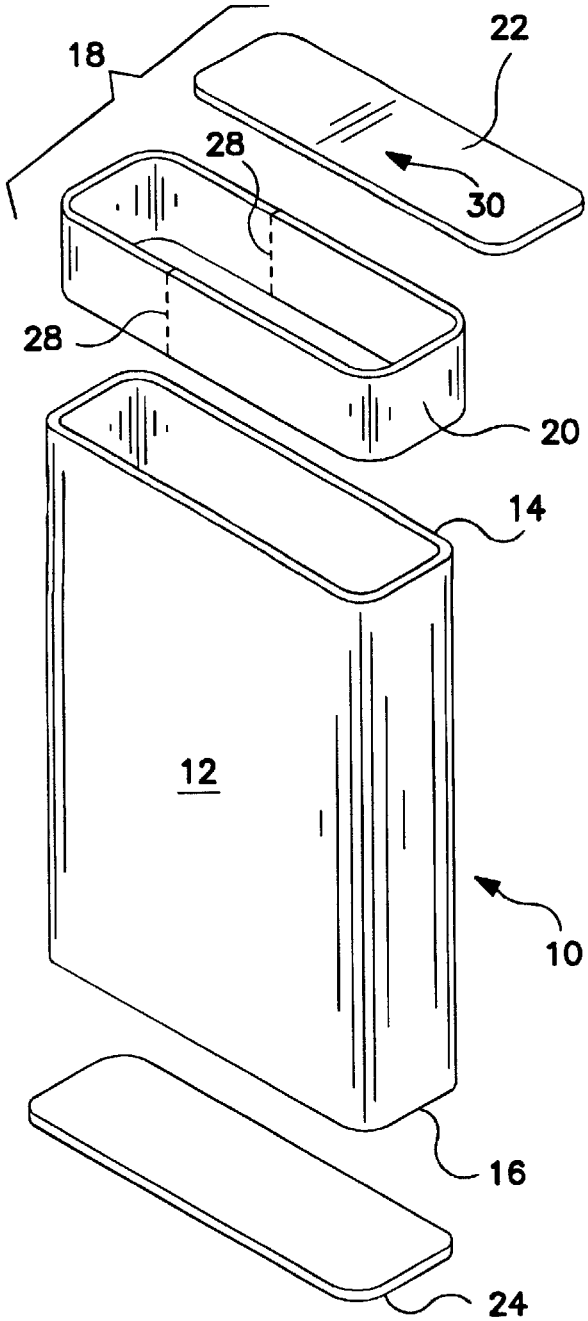
FIG. 3 is a perspective exploded view of the paper can of FIGS. 1–3 of the present invention.

One embodiment of a paperboard container 10 of the present invention is shown generally in FIGS. 1–3. The container 10 includes a main body or tube portion 12 having a top edge 14 and a bottom edge 16. The body 12 has side walls defining a chamber that is opened at its top and bottom. The body 12 shown in the drawings is generally quadrilateral in plan view. However, the body could be circular, triangular, or any other desired shape. Two piece lid 18 is formed from an encircling band 20 and a lid panel 22. Container 10 also includes bottom panel 24.

The top edge 26 of lid 18 may be straight or curled, as desired for a particular application. Band 20 preferably has two vertical lines of perforations or deep score lines 28. Lid panel 22 may be provided with a transverse score 30, that may serve as a fold line, for facilitating opening of the flip top portion 32 of the lid 18. Band 20 may be formed as a strip of material that has been formed into a tube, and then cut into short sections, into each of which a corresponding lid panel 22 may be inserted and affixed.

Once the completed lid 18 has been fabricated, it may be placed onto and affixed to the top edge 14 of body 12. Typically, lid 18 will have length and width dimensions that are greater than the top edge 14 of body 12. Accordingly, band 20 will circumferentially surround the top of body 12.

A portion of the inner surface of band 20 will be provided with an adhesive material, or a heat-or sonically activatable layer (for example a lamination of sonically weldable material), to affix lid 18 in place.

Preferably, the portion 34 of lid 18 that remains fixed to body 12 will be provided with a substantial amount of adhesive, or sonically or heat-activatable material, on the inner surface of its portion of band 20. However, the flip top portion 32 preferably will have only a few spots of adhesive or heat or sonically activatable material. This is so that upon application of a moderate amount of upward pulling, the weak bonds between the band portion of flip top 32, can be broken, band 20 can be severed along score/perforation lines 28, and flip top portion 32 pivoted about score 30 upward and away from top edge 14 of body 12.

As previously mentioned, according to a preferred embodiment of the invention, the lid may be completely formed, prior to affixation to the top of body 12. For example, band 20 may be wrapped around lid panel 22 prior to affixation of lid 18 to body 12. Alternatively, band 20 may be affixed to body 12, prior to insertion of lid panel 22. In either embodiment, placement of the lid panel 22 into band 20 may be accomplished by any suitable manner, such as the technique illustrated in *Christensson*, U.S. Pat. No. 4,599,123. In such a technique, either or both of the bottom surface of the lid panel 22, or the inside surface of the band 20, would be covered in a sonically weldable material. The presence of such a material may be provided by laminating a layer of sonically weldable material to a base layer of, for example, sufficiently heavy cardboard material. The outer surface of the base layer may further have an additional lamination layer that is covered in printing, graphics, etc.

To position the lid panel, the band is surrounded by a clamping structure that may incorporate an ultrasonic horn structure. Above the band, a female die member is provided with an aperture that is of the desired dimensions. A laminated lid panel member is placed above the die, and a male forming member pushes the lid panel member through the female die member and into the band. Edge regions of the lid panel member (see FIG. 6) will be turned upward and into contact with portions of the inside surface of the band. The male forming member may include expandable structures or other structures that will enhance the contact between the upwardly turned portions of the lid panel and the adjacent portions of the band. The ultrasonic horn will be activated, and a localized weld will be formed.

Alternatively, a heat activatable layer may be employed, and heating of the layer may be accomplished by generally heating the clamping structures used to position the lid panel in the band.

Figure 14:
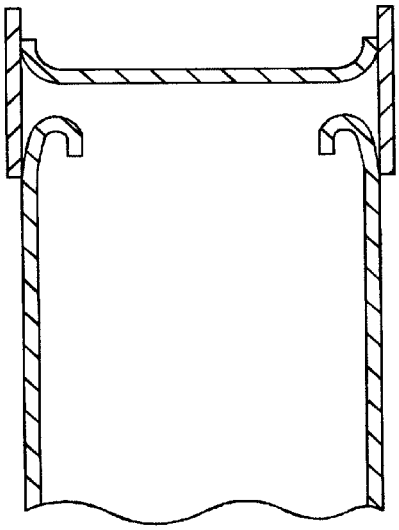
FIG. 14 is a side elevation, in section, of an alternative embodiment showing how the top edge of the body may be curled inward.
Figure 15:
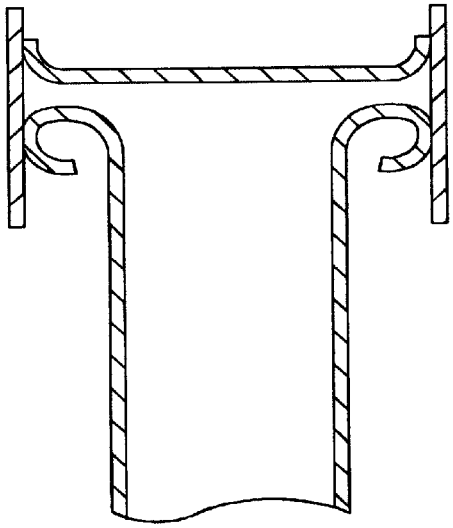
FIG. 15 is a side elevation, in section, of an alternative embodiment showing how the top edge of the body may be curled outward.

After the lid panel has been welded to the band, the top edge(s) of the band and/or the upwardly turned portion of the lid panel may be curled inward, if desired, using known techniques for inwardly turning the edges of tubular bodies. The curled inward portion of the band may or may not be curled so much as to actually cover the upturned peripheral edges of the lid panel. In the figures, the curled inward portion does not cover the upturned peripheral edges of the lid panel. Alternatively, the top edge region of the band may be left in a straight vertical orientation. Similarly, the top edge region of the tubular body portion may be left in a straight vertical orientation, as illustrated, or curled inwardly or outwardly, if desired, as shown in FIGS. 14 and 15, respectively.

Figure 13:
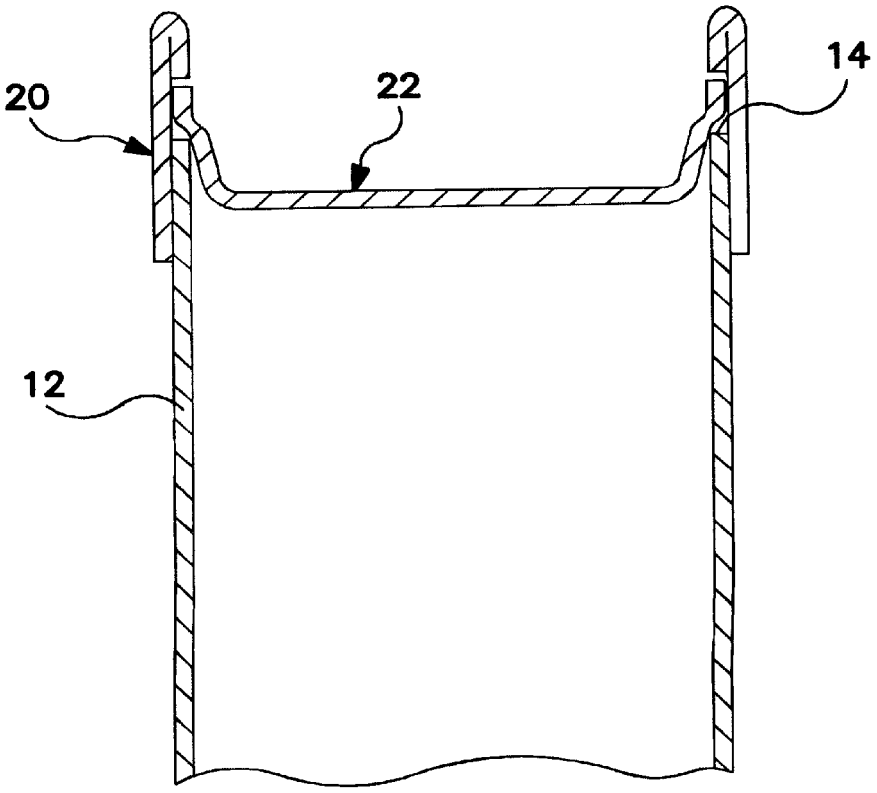
FIG. 13 is a side elevation, in section, of an alternative embodiment showing how the lid may have a plug-like structure.

Depending upon the shape of the male forming member, and the size of the unformed lid panel, the lid panel 22 may be formed with a deep profile, to form a plug structure that fits snugly into the inside of the top of body 12, so that top edge 14 of body 12 actually wedges between the plug structure and band 20. See, for example, FIG. 13. In this manner, a form of seal can be created, to help maintain freshness of perishable contents of the container. A second cooperating male die member may also be used to mate with the first male die member, to facilitate creation of the plug configuration.

After the lid has been attached to the container, the container is inverted, and the product to be packaged is poured or otherwise placed in the container, through the open bottom of the tubular body portion. A bottom panel 24 is then inserted and affixed to the bottom end of the tubular body portion, using any desired conventional technique. For example, the bottom panel may be laminated, with an inner surface layer of a heat or sonically activatable material, or glueable. Upon insertion of the bottom panel, using a male forming member, and holding the bottom of the container with a surrounding die, that is heated or includes an ultrasonic horn, the peripheral edges of the bottom panel may be adhered to inside surfaces of the bottom end region of the tubular body member.

In the embodiment of FIGS. 1–3, each of the tubular body 12, lid panel 22 and band 20 may be fabricated from one or more layers of paperboard material, such as cardboard, paperboard, corrugated or flexible films, though other materials may be employed, as desired or dictated by the requirements of any particular application. The material may be laminated with one or more layers (inside or outside) of a moisture resistant material, to resist intrusion of moisture into the interior of container 10 and to aid in sealing.

As an alternative to sizing and placing the lid on the tubular body portion in such a way that the band surrounds and is in contact with the outside of the top of the tubular body portion, the lid may be configured so that the band lies to the inside of the tubular body portion wall. While this may require some accommodation at the flip top portion, such as by beveling a portion of the band to clear the top edge of the body, such modifications may readily be accomplished by one of ordinary skill in the art, having the present disclosure before them.

The paper cans of the present invention may include an inner sealing membrane that may be provided in order to further preserve freshness of perishable or semi-perishable contents, until purchase by a consumer. Such interior membranes may also serve as further evidence of tampering, if broken or otherwise disturbed.

Figure 4:
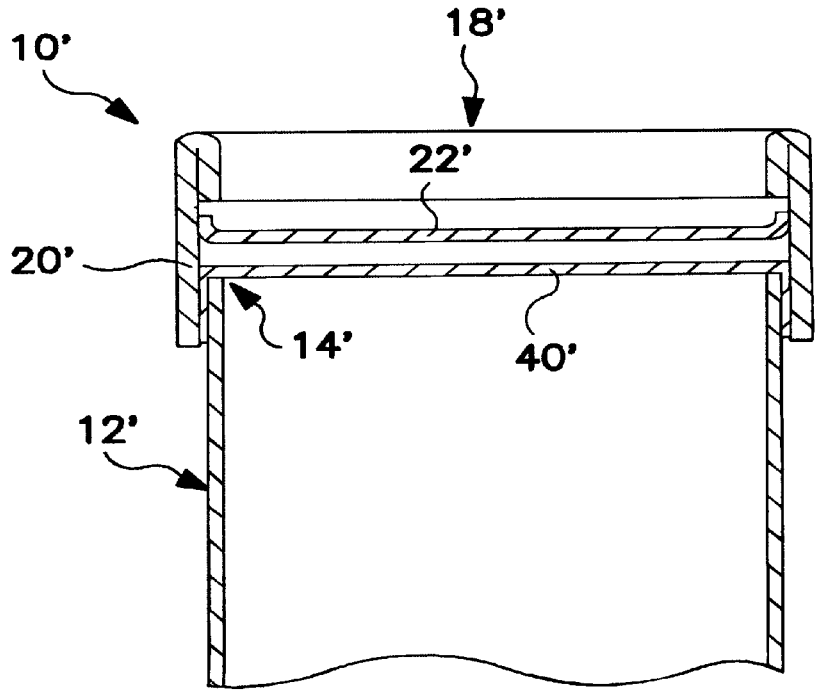
FIG. 4 is an end elevation, in section, of the paper can of FIGS. 1–3, showing a sealing membrane in place between the lid and the tubular body, according to one embodiment of the invention.
Figure 5:
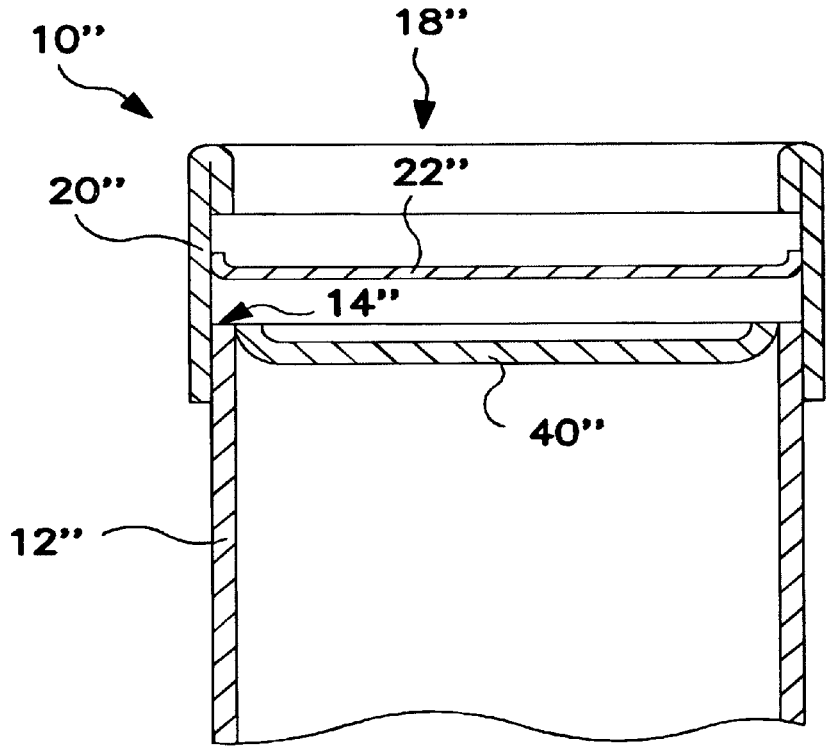
FIG. 5 is an end elevation, in section, of the paper can of FIGS. 1–3, showing a membrane positioned within the top opening of the tubular body, according to another embodiment of the invention.

FIGS. 4 and 5 illustrate two embodiments of the paper can of the present invention, incorporating interior membranes.

In FIG. 4, container 10' has tubular body 12', and lid 18', formed from band 20' and lid panel 22'. Membrane 40' is interposed between lid 18' and the top edge 14' of tubular body 12'. Preferably, membrane 40' is fabricated from any suitable paper or plastic material, and covers the entire top opening of tubular body 12'. In addition, preferably membrane 40' is substantially thinner than the material of tubular body 12' or lid 18'. Membrane 40' may be held in place by a bead of adhesive material (not shown) or may itself be fabricated from a heat or sonically activatable material, to adhere to top edge 14' and the adjacent outside surface of tubular body 12', if desired. Alternatively, membrane 40' may be precisely cut, so that it does not extend significantly down the outside surfaces of tubular body 12'. The placement of membrane 40' onto tubular body 12' may be accomplished according to any one of several known techniques. Accordingly, a detailed discussion of the methods and/or apparatus used is not believed necessary for a complete understanding of this aspect of the container.

After placement of membrane 40' on tubular body 12', lid 18' may then be applied to or affixed to tubular body 12', in either of the ways previously discussed, with respect to the container embodiment of FIGS. 1–3.

In the alternative embodiment of FIG. 5, membrane 40" is inserted into the top opening of tubular body 12" and is affixed around its edges to the inside surface of tubular body 12". Membrane 40" may be inserted into tubular body 12" and held in place by a circumferentially placed bead of adhesive (not shown). Alternatively, membrane 40" (or at least one layer thereof) may be fabricated from a heat or sonically activatable material, so that upon insertion of membrane 40", using a male forming member (not shown), the activatable layer may be activated by a collar surrounding tubular body 12" (not shown) that incorporates a heating element or an ultrasonic horn. Such schemes are known in the art, through examples such as the previously mentioned *Christensson* '123 patent.

In either of the embodiments of FIGS. 4 or 5, the membranes 40', 40" may be provided with perforations, pull tabs, scores, or other features (not shown, but known in the art of sealing membranes) for facilitating breaching or removal of at least a portion of the membrane 40' or 40", to permit access to the contents of the container 10', 10".

Figure 6:
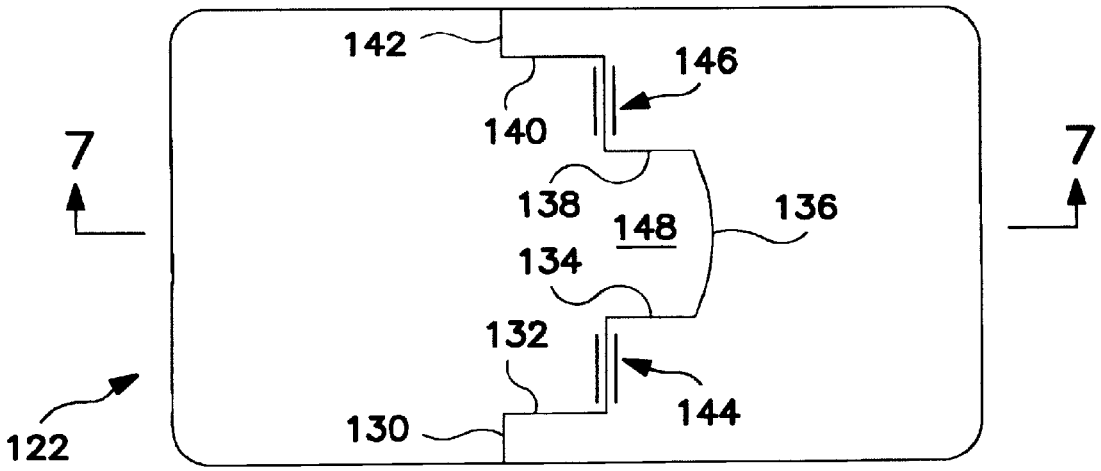
Fig. 6 is a plan view of an alternative lid panel, according to an alternative embodiment of the invention that provides for a "stay-open" feature.
Figure 7:
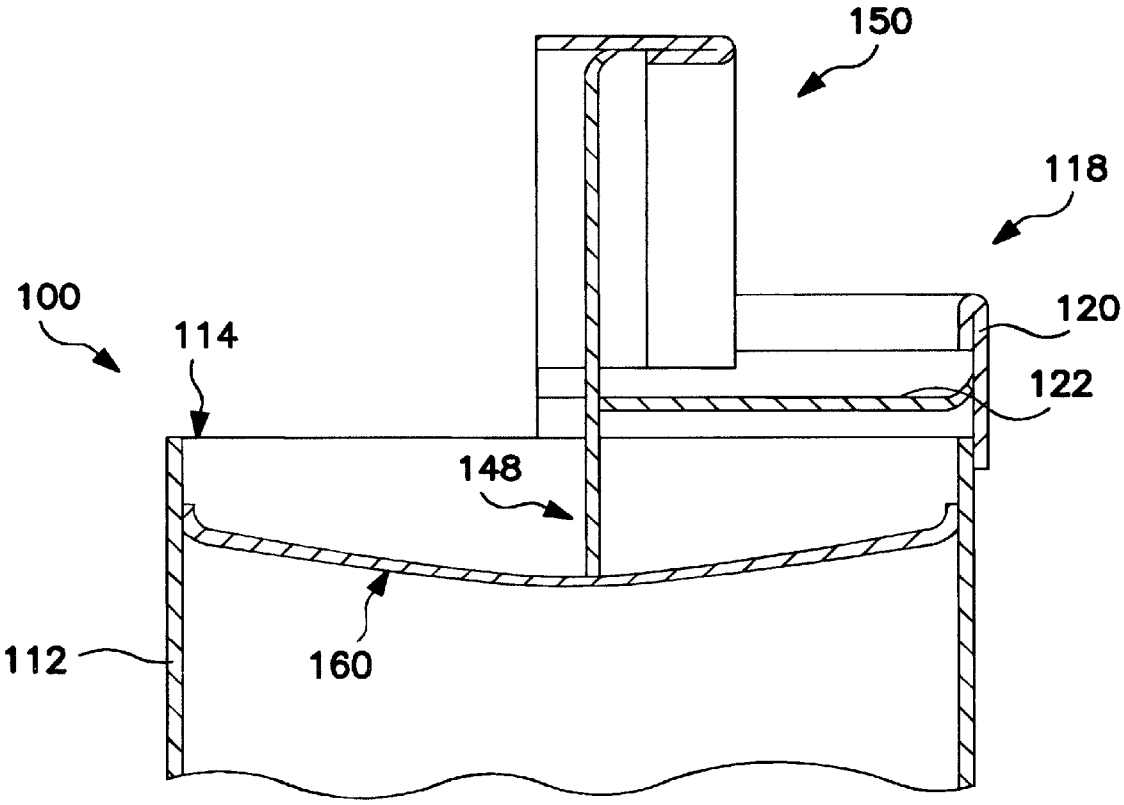
FIG. 7 is a side elevation, in section, of an alternative paper can container, incorporating the lid panel of FIG. 6.
Figure 8:
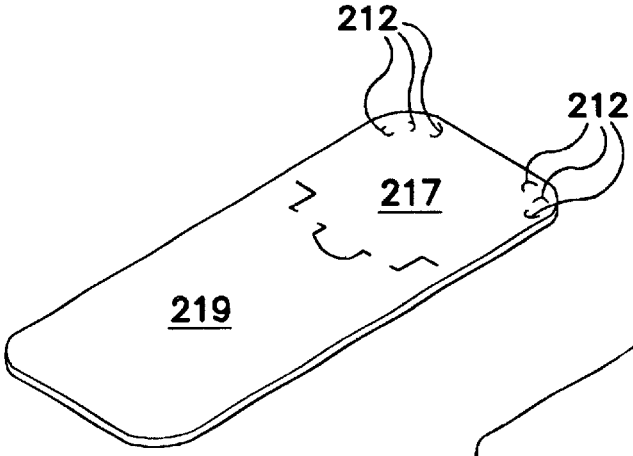
FIG. 8 is a perspective view of an alternative lid panel.
Figure 10:
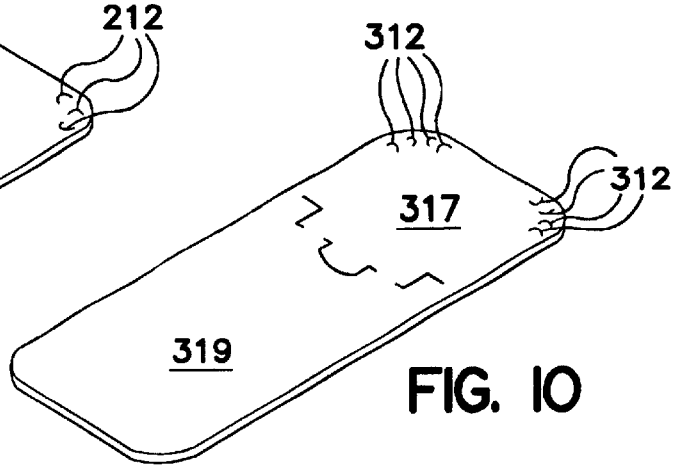
FIG. 10 is a perspective view of an alternative lid panel.
Figure 9:
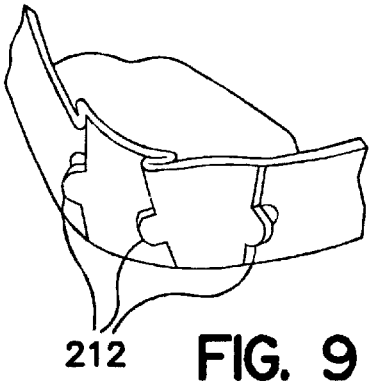
FIG. 9 is a perspective view of the alternative lid panel of FIG. 8, showing how the lid panel can be configured to provide enhanced friction, relative to the tubular body portion.
Figure 11:
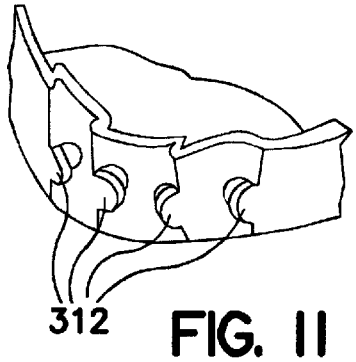
FIG. 11 is a perspective view of the alternative lid panel of FIG. 10, showing how the lid panel can be configured to provide enhanced friction, relative to the tubular body portion.

FIG. 6 is a top plan view of an alternative lid panel 122, for use in an alternative embodiment paper can 100, shown in FIG. 7. Lid panel 122 includes a series of cuts 130, 132, 134, 136, 138, 140 and 142, and two fold lines 144, 146. When lid panel 122 is placed into a container, having a configuration like the embodiment of FIG. 5, for example, the resulting container is that shown in FIG. 7. Container 100 includes tubular body 112, having top edge 114. Lid 118 includes band 120 and lid panel 122. When the flip top portion 150 is pivoted upward, it pivots around fold lines 144, 146. Cuts 134, 136 and 138 form a tab 148 that, upon pivoting of flip top portion 150, presses down into membrane 160. The resulting tension creates friction that tends to hold flip top portion 150 in the position indicated in FIG. 7.

Other embodiments of the invention are shown in FIGS. 8–11. These embodiments illustrate lid panels that would be used, in which the lid panel is drawn deeply enough, and positioned relative to the surrounding band, and the top edge of the tubular body portion, that the lid panel acts as a "plug" to engage the inside surface of the top of the tubular body portion. The container (not shown) associated with the lid panel 219 and 319 of FIGS. 8 and 10, may otherwise be of the configuration shown in FIGS. 6 and 7, but with the plug-like feature previously mentioned. Lid panels 219 and 319 are similar to lid panel 122. The difference lies in the peripheral edges of lid front portions 217 and 317. Lid front portions 217 and 317 include equidistantly spaced teeth 212 and 312 (FIGS. 9 and 11) on their peripheral edges. Engagement of teeth 212 and 312 with the tubular body portion (not shown) creates a further frictional engagement between the lid and the inside surface of the top edge region of the tubular body portion that will help maintain the pivoting portions of the lid panels 219, 319 in their respective closed positions.

Figure 12:
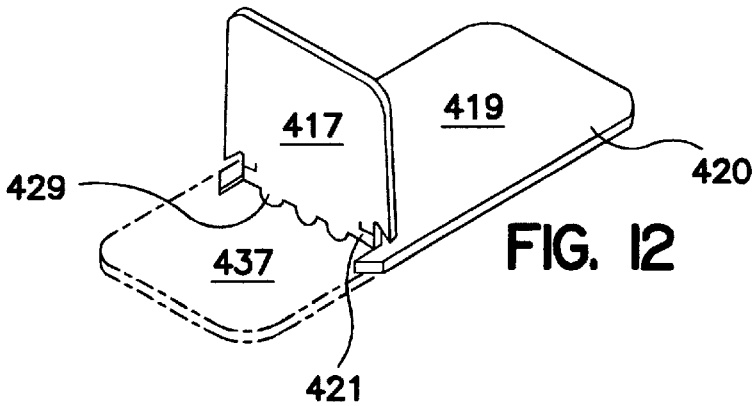
FIG. 12 is a perspective view of another alternative lid panel, according to another alternative embodiment of the invention.

Still another alternative embodiment for the lid panel is shown in FIG. 12. The container (not shown) associated with FIG. 12 may have substantially the same construction as the container 100 of FIG. 7. It varies in the construction of lid panel 419. Fold line 421 separates the lid panel front portion 417 from the lid panel rear portion 420. Fold line 421 includes three spaced tabs or détentes 429, that may be equally or unequally spaced. The tab 429 is formed to extend toward the lid panel rear portion 320. To form each of tabs 429, a partial cut, in a semicircular shape, is formed on the bottom side of lid panel 419. The engagement of tabs 429 with the membrane (not shown) creates a further frictional engagement between the lid and the membrane that will help maintain the flip top portion of the lid in its opened position.

The foregoing description and drawings merely explain and illustrate the invention, and the invention is not limited thereto except insofar as the pending claims are so limited as those skilled in the art who have the disclosure before them will be able to make modifications and variations therein without departing from the scope of the invention.

What is claimed is:

1. A paperboard container for releasably dispensing contents contained therein, the container being convertible from a substantially sealed orientation to a substantially open, dispensing orientation and back to the substantially sealed orientation, the paperboard container comprising:

a tubular body having an upper edge defining an upper opening;

a lid, including a substantially planar lid panel member having a peripheral edge region, the lid panel member being operably configured to extend across at least a portion of the upper opening;

the lid further including a surrounding band, operably affixed to the lid panel member along the peripheral edge region thereof, which surrounding band surrounds the entire periphery of the upper opening;

the peripheral edge of the lid panel being operably affixed to at least a portion of the surrounding band, where said peripheral edge is juxtaposed to and contacts a sidewall portion of said surrounding band;

at least portions of the surrounding band being affixed to the tubular body along at least a portion of the upper edge thereof;

the lid having a fixed back portion, a hinge portion, and a movable front portion, pivotable between a closed position and an open position, the movable portion including a portion of the surrounding band that pivots with said movable portion; and a container bottom opposite said lid.

2. The paperboard container according to claim 1, further comprising a membrane extending across the upper opening of the tubular body portion, under the lid panel, and substantially independent of the lid portion.

3. The paperboard container according to claim 2, wherein the membrane is positioned on the top edge of the upper opening of the tubular body portion.

4. The paperboard container according to claim 2, wherein the membrane is inserted into and affixed to inside surfaces of the upper opening of the tubular body portion.

5. The paperboard container according to claim 2 wherein the hinge portion further comprises at least one locking tab operably extending from the hinge portion, when the movable front portion of the lid is in the open position, for frictionally engaging the membrane, to maintain the movable front portion of the lid in the open position.

6. The paperboard container according to claim 1, wherein the lid panel is plug-shaped, so as to extend into the upper opening of the tubular body portion, when the movable front portion of the lid is in its closed position.

7. The paperboard container according to claim 6 wherein the movable front portion of the lid includes at least one tooth for engaging the container member upper edge when the top member is in its sealed orientation.

8. The paperboard container of claim 5 wherein the hinge portion includes at least two tabs extending rearwardly toward the rear portion, the at least two hinges being sized to engage the membrane when the movable front portion of the lid is in its open orientation and to hold the front portion in the open orientation.

9. The paperboard container according to claim 1, wherein the bottom comprises a bottom panel inserted into and adhered to inside surfaces of a bottom end region of the tubular body portion.

10. The paperboard container according to claim 1, wherein the lid is formed by insertion of the lid panel into the band, the lid panel having a width and length greater than the width and length of the band, causing peripheral edges of the lid panel to become upturned and positioned against inside surfaces of the band, and the upturned peripheral edges of the lid panel are adhered to the inside surfaces of the band.

11. The paperboard container according to claim 10, wherein a topmost edge region of the band is curled inward.

12. The paperboard container according to claim 10, wherein a topmost edge region of the band is left in a straight vertical orientation.

13. The paperboard container according to claim 10, wherein a topmost edge region of the band is curled outward.

14. The paperboard container according to claim 1, wherein the lid is formed by positioning the band about the lid panel, the lid panel having a width and length greater than the width and length of the band, causing peripheral edges of the lid panel to become upturned and positioned against inside surfaces of the band, and the upturned peripheral edges of the lid panel are adhered to the inside surfaces of the band.

15. The paperboard container according to claim 1, wherein the upper edge of the tubular body is curled inward.

16. The paperboard container according to claim 1, wherein the upper edge of the tubular body is left in a straight vertical orientation.

17. The paperboard container according to claim 1, wherein the upper edge of the tubular body is curled outward.

* * * * *